US005713572A

United States Patent [19]

Hagiwara

[11] Patent Number: 5,713,572

[45] Date of Patent: Feb. 3, 1998

[54] PUSHER GAME APPARATUS

[75] Inventor: Takashi Hagiwara, Tokyo, Japan

[73] Assignee: Sigma, Incorporated, Tokyo, Japan

[21] Appl. No.: 798,332

[22] Filed: Feb. 10, 1997

[51] Int. Cl.[6] ..... A63F 7/02

[52] U.S. Cl. ..... 273/138.3; 273/138.1

[58] Field of Search ..... 273/138.1, 139, 273/144 R, 138.3, 459, 451

[56] References Cited

U.S. PATENT DOCUMENTS

| | | | |
|---|---|---|---|
| 4,662,636 | 5/1987 | Crompton | 273/138 A |
| 5,275,402 | 1/1994 | Malavazons et al. | 273/138 A |
| 5,297,816 | 3/1994 | Becchio | 273/138 A |
| 5,507,490 | 4/1996 | Hagiwara | 273/138 |

FOREIGN PATENT DOCUMENTS

| | | | |
|---|---|---|---|
| 07116335 | 5/1995 | European Pat. Off. . | |
| 4338755A1 | 6/1994 | Germany . | |
| 2124913 | 2/1984 | United Kingdom | 273/138 R |
| 2226766 | 7/1990 | United Kingdom | 273/140 |

*Primary Examiner*—Mark S. Graham
*Attorney, Agent, or Firm*—Hickman Beyer & Weaver, LLP

[57] ABSTRACT

A pusher game apparatus provides at least one jackpot detecting section which detects a disk dropped from a guiding means. The stroke of reciprocation of the pusher is changed according to whether or not the disk is detected by the jackpot detecting section, thereby varying the maximum number of medals which can be acquired. Accordingly, the pusher game apparatus can provide the game with unexpectedness, giving much stronger impact on players.

6 Claims, 6 Drawing Sheets

PUSHER GAME APPARATUS

BACKGROUND OF THE INVENTION

1. Field of the Invention

The present invention relates to a so-called pusher game apparatus.

2. Related Background Art

Pusher game apparatus refers to a kind of game apparatus in which a pusher slidably reciprocating on a game board pushes medals into a chute, so that some medals are dispensed to a player. Conventionally, in this kind of pusher game apparatus, the pusher has a constant stroke, thereby limiting the maximum number of medals dropped into the chute. Accordingly, the game has been lacking unexpectedness, giving a weak impact on players.

SUMMARY OF THE INVENTION

In view of the foregoing circumstances, it is an object of the present invention to provide a pusher game apparatus which can change the stroke of the pusher so as to make the maximum number of acquirable medals variable, thereby yielding unexpectedness in terms of game and giving a strong impact on players.

The pusher game apparatus of the present invention comprises:

a disk insertion slot into which a disk is inserted;

a guiding means for guiding downwardly the disk inserted into the disk insertion slot;

a game board disposed substantially horizontally below the guiding means so as to receive the disk dropped from the guiding means;

a discharging means disposed on at least one end side of the game board for discharging the disk out of the pusher game apparatus;

a pusher disposed slidably on the game board and movable reciprocally toward and away from the one end of the game board;

at least one jackpot detecting section for detecting the disk dropped from the guiding means;

a control means for selecting a stroke of the pusher based on a detection signal transmitted from the jackpot detecting section upon detecting the disk and for transmitting a control signal based on thus selected stroke; and a driving means for driving the pusher capable of changing the reciprocal stroke of the pusher based on the control signal from the control means.

In the present invention, when the medal is detected by the jackpot detecting section, the maximum number of medals being dropped changes according to the difference in strokes. For example, in cases where the stroke is made greater when the medal is detected by the jackpot detecting section than when not detected, thereby a larger number of medals are expected to be acquired.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, a pusher game apparatus in accordance with an embodiment of the present invention will be explained with reference to drawings.

Figure 1:
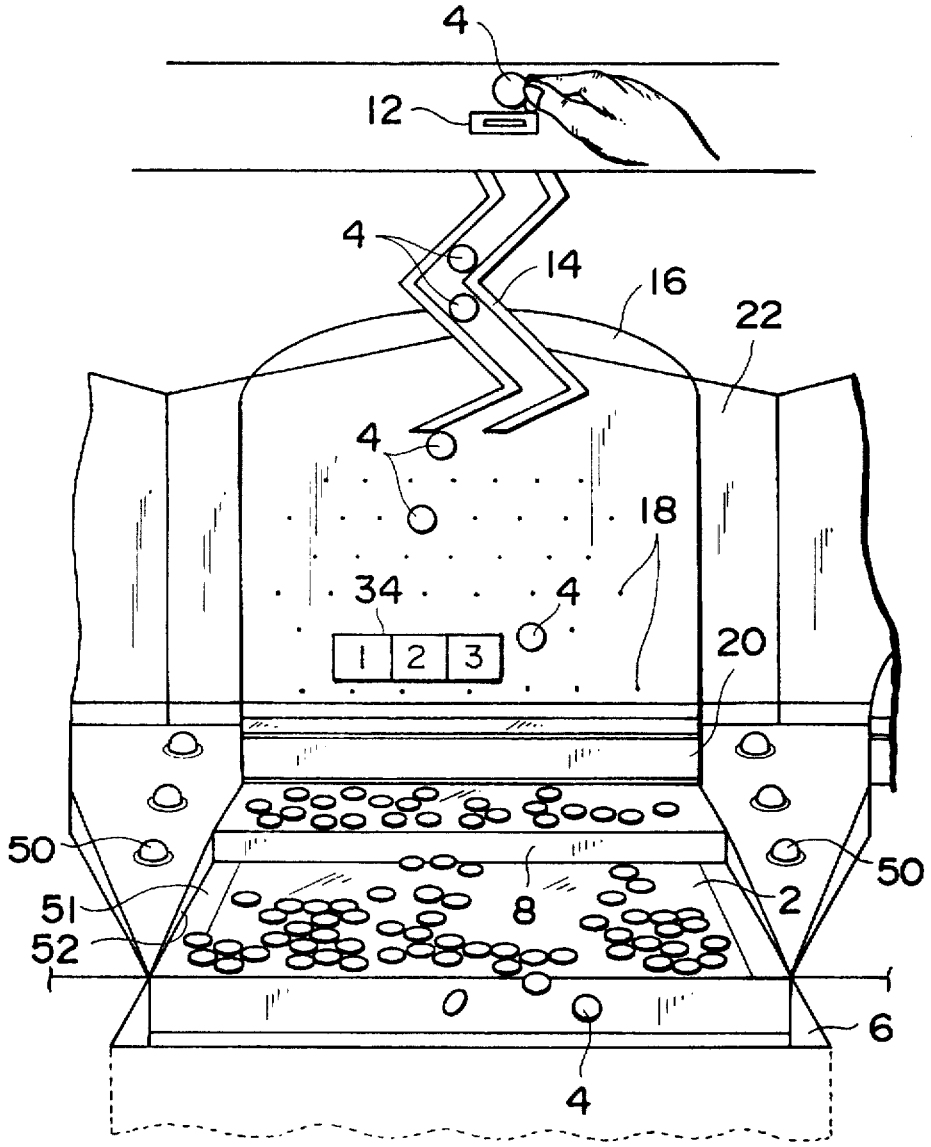
FIG. 1 is a schematic front view showing a pusher game apparatus in accordance with an embodiment of the present invention.
Figure 2:
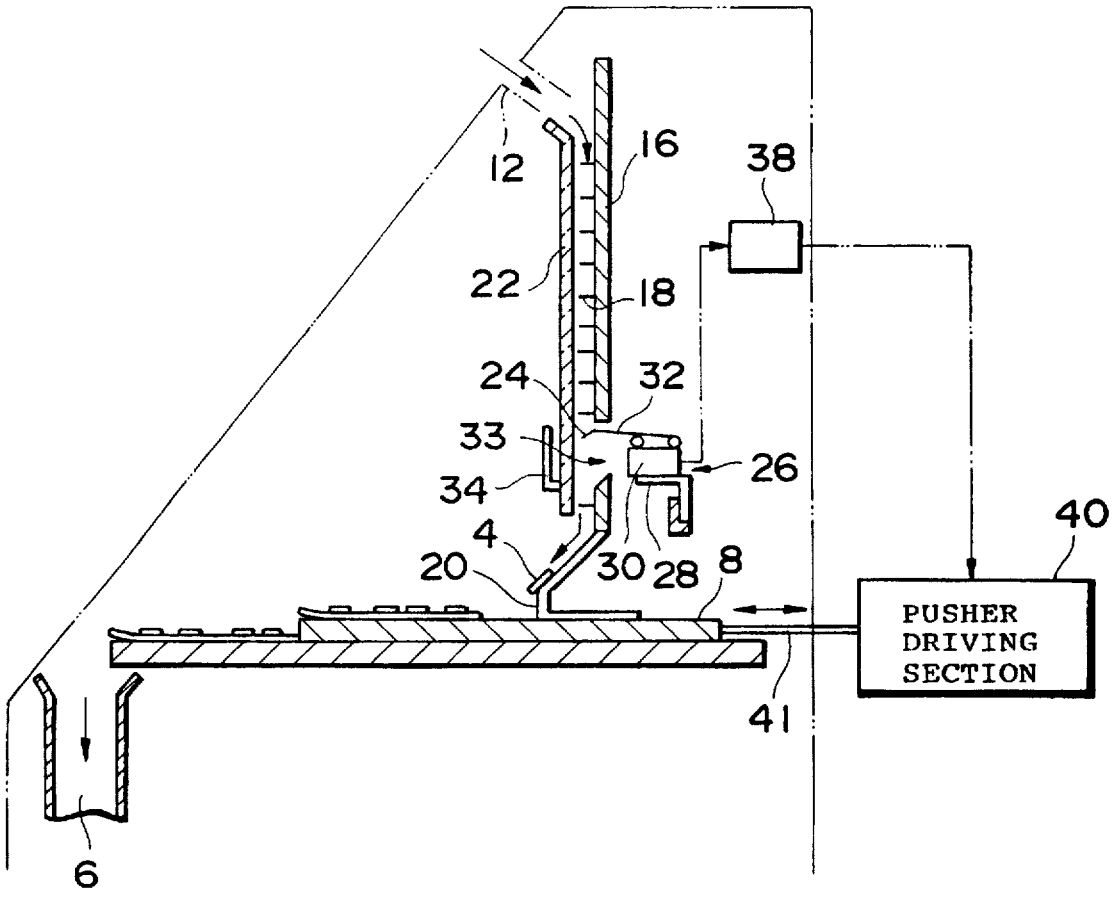
FIG. 2 is a vertical cross-sectional view of the pusher game apparatus in FIG. 1 taken on a plane orthogonal to its guiding board and game board.

FIG. 1 is a schematic front view showing the pusher game apparatus in accordance with the embodiment of the present invention, while FIG. 2 is a vertical cross-sectional view of the main part thereof. In these drawings, substantially horizontally fixed to the inside of a main body 1 of the pusher game apparatus is a game board 2, on which a number of disks such as medals 4 are placed. Formed on the front side (on the left side in FIG. 2) is a chute 6 as a discharging means for receiving the medals 4 dropped from the game board 2 and discharging the medals 4 from the main body 1 of the pusher game apparatus. Mounted on the upper surface of the game board 2 is a pusher 8 which is reciprocated backward and forward by a pusher driving section 40 while in contact with the game board 2 thereunder. In the following, the front side in FIG. 1 is referred to as "front" side, whereas the side opposite thereto is referred to as "rear" side. Disposed on a side part of the game board 2 is a medal supplement mechanism 51 which will be explained later.

Formed in the upper portion of the main body 1 of the pusher game apparatus is a medal insertion slot 12 into which the medals 4 are inserted. Attached to the medal insertion slot 12 is a guiding path 14 extending downward in zigzag. Below the guiding path 14, a guiding board 16 for guiding the medals 4 downward is disposed vertically with respect to the pusher 8. On the front face of the guiding board 16, a number of pins 18 for hitting the medals 4 are disposed at appropriate intervals. Also, as shown in FIG. 2, disposed at the lower end of the guiding board 16 is a stopper 20 with which the pusher 8 is slidably in contact such that, when the pusher 8 retracts, the medals 4 on the pusher 8 are pushed toward the front end portion thereof. Disposed in parallel to and in front of the guiding board 16 is a transparent plate 22, against which the medals 4 can securely descend along the guiding board 16 and through which a player can observe with eyes how the medals 4 descend.

In the guiding board 16, disposed are jackpot detecting sections 24 for providing the player with bonuses when the medals 4 come into contact therewith. Attached to each jackpot detecting section 24 is a microswitch 26 including a switch main body 30, which is supported by a carrier 28 on the rear side of the guiding board 16, and an actuator 32 disposed thereon. The tip of the actuator 32, i.e., jackpot detecting section 24, projects through an opening 33 from the rear side of the guiding board 16 such that the inserted medals 4 come into contact therewith while descending. Also, in this embodiment, a display board 34 is attached to the transparent plate 22 so as to indicate the position of the jackpot detecting sections 24 while making the mechanisms of the jackpot detecting sections 24 themselves invisible to the player.

Used as the microswitch 26 in this case is of normally-open type. Namely, the microswitch 26 maintains its off state in cases where the inserted medals 4 do not come into contact with its corresponding jackpot detecting section 24 while descending, whereas it is turned on when any medal 4 comes into contact with the jackpot detecting section 24. When the microswitch 26 is turned on, a detection signal is transmitted to a control circuit (control means) 38 which, for example, comprises a microcomputer. From this detection signal, the kind of jackpot detecting sections 24 is judged. The control circuit 38 selects an appropriate signal based on this judgment and transmits thus selected signal to the pusher driving section 40 for driving the pusher 8. Used as the pusher driving section 40 in this embodiment is a variable stroke type linear motor (not depicted) which can change the stroke of reciprocation of the pusher 8 in response to the control signal. This linear motor includes a linear rail and a movable member which can move on this rail. The pusher 8 is moved by way of a shaft 41 attached to the movable member.

Figure 3:
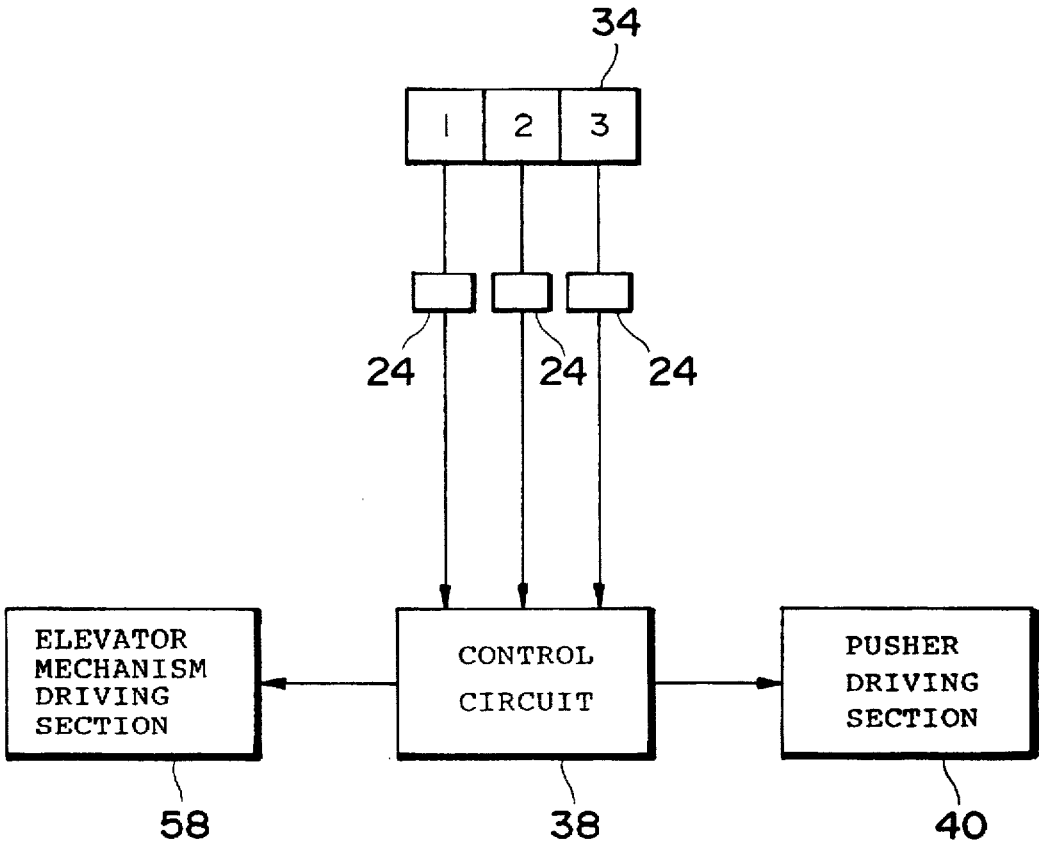
FIG. 3 is a block diagram showing the relationship between a jackpot detecting section, a pusher driving section, a control circuit, and an elevator mechanism driving section.
Figure 4A:
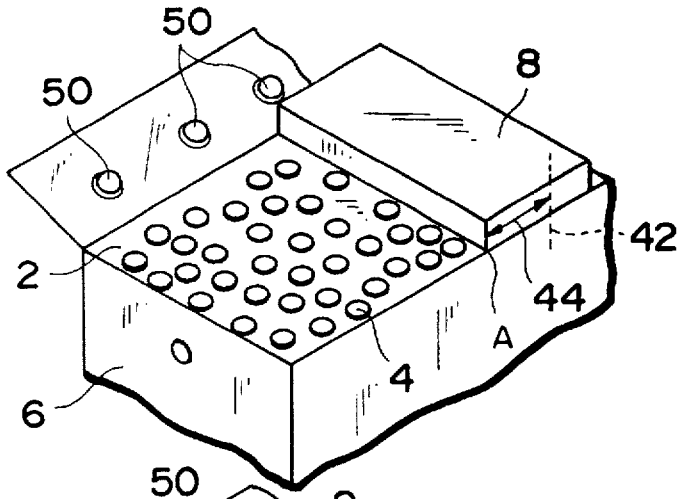
FIGS. 4A to 4C are perspective views showing strokes of a pusher in cases where bonuses are provided and not.
Figure 4B:
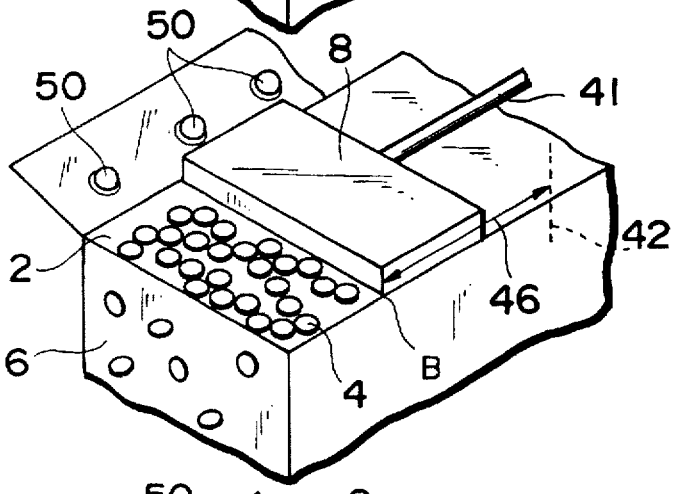
Figure 4C:
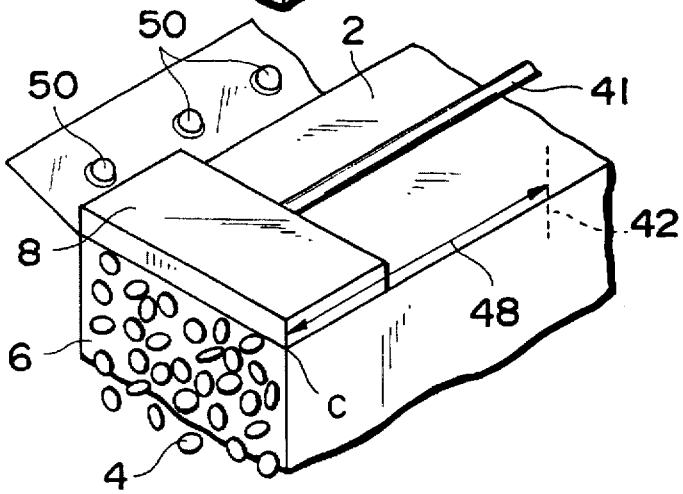

In the following, the operational control of the pusher driving section 40 will be explained with reference to FIG. 3 and FIGS. 4A to 4C. FIG. 3 is a block diagram showing the control system of the pusher driving section 40, whereas FIGS. 4A to 4C are perspective views showing strokes of the pusher 8 when bonuses are provided and not provided. As shown in FIG. 3, the display board 34 indicates three numbers of "1", "2" and "3". These numbers correspond to the respective jackpot detecting sections 24 and, in this embodiment, further correspond to "small hit", "medium hit" and "big hit", respectively.

When the medal 4 is not detected by the jackpot detecting sections 24, no detection signal is obtained from the jackpot detecting sections 24, whereby the pusher 8 reciprocates with a stroke indicated by an arrow 44 in FIG. 4A. Here, the front end portion of the pusher 8 reciprocates between the position of "A" and the position of a broken line 42 in the drawing. The position of the broken line 42 corresponds to the front end portion of the pusher 8 when retracted to the maximum, regardless of whether medals are detected or not.

In cases where the medal 4 is detected by the jackpot detecting section 24, for example, with "1", the detection signal is transmitted to the control circuit 38, and a control signal including information about "small hit" is transmitted from the control circuit 38 to the pusher driving section 40. In this case, the pusher 8 reciprocates with a stroke indicated by an arrow 46 shown in FIG. 4B, such that the front end portion thereof moves to the position of "B" which is located further in front of "A". The stroke in this case is greater than that in the cases where no medal 4 is detected by the jackpot detecting sections 24. This difference in strokes becomes a bonus to the player. Also, when the medal 4 is detected with "3", the detection signal thereof is transmitted to the control circuit 38, and a control signal including information about "big hit" is transmitted from the control circuit 38 to the pusher driving section 40. Here, the pusher 8 is moved till the front end portion thereof coincides with the front end portion of the game board 2 as shown in FIG. 4C, i.e., moved to the position of "C" depicted therein, whereby all the medals 4 placed on the game board 2 drop into the chute 6. In this case, the pusher 8 is moved with a stroke indicated by an arrow 48 depicted therein. When the medal 4 is detected with "2", the detection signal thereof is transmitted to the control circuit 38, and a control signal including information about "medium hit" is transmitted from the control circuit 38 to the pusher driving section 40. Here, the pusher 8 is moved such that its stroke becomes greater than that of "small hit" but smaller than that of "big hit."

Also, in this embodiment, as shown in FIG. 1 and FIGS. 4A to 4C, message lamps 50 for jackpots and a speaker (not depicted) are disposed on a side portion of the game board 2 or the like. When the medals 4 are detected by the jackpot detecting sections 24, the message lamps 50 blink fast for a predetermined time, while a message sound is output from the speaker. The blinking rate of the message lamps 50, music from the speaker, and the like may be selected according to the kind of jackpot detecting sections 24.

Figure 5A:
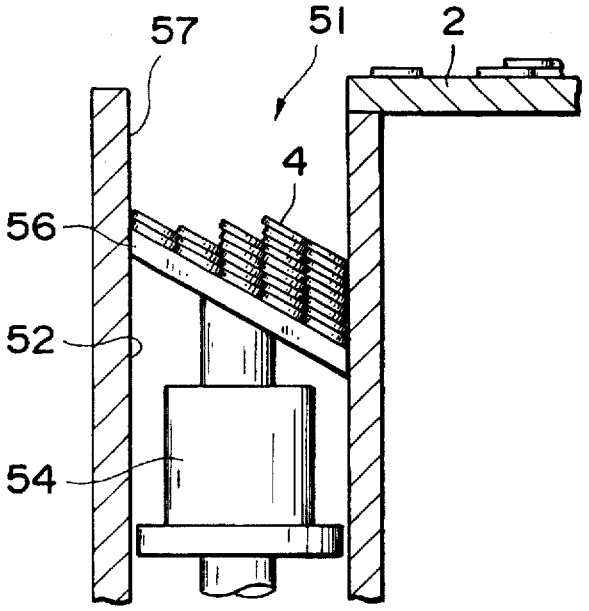
FIGS. 5A and 5B are process drawings showing an operation for supplementing medals.
Figure 5B:
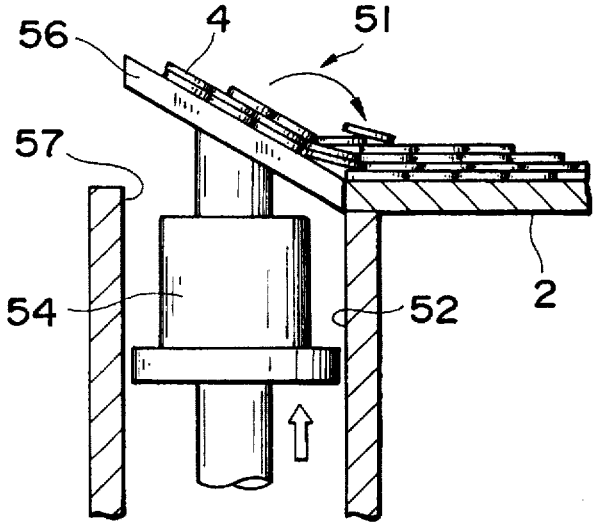

As the player is provided with bonuses mentioned above, the number of the medals 4 on the game board 2 decreases. Therefore, in the present invention, the medal supplement mechanism 51 for supplementing the medals 4 on the game board 2 is disposed. This medal supplement mechanism 51 is disposed within or around the game board 2. As shown in FIGS. 5A and 5B, the medal supplement mechanism 51 includes a pocket 52 for accumulating the dropped medals 4, an elevator rod 54 which is disposed within the pocket 52 as an elevator mechanism, and a slant plate 56 which is disposed at the upper end of the elevator rod 54 and is adapted to return the medals 4 which have dropped into the pocket 52 to the game board 2. The elevator mechanism can be constituted, for example, by a known mechanism comprising a motor, a pulley, and a belt, or a known mechanism using a solenoid. The elevator mechanism including a motor, a pulley, and a belt is useful for returning the medals 4 onto the game board 2 in a long period of time; whereas the elevator mechanism using a solenoid is useful for returning the medals 4 onto the game board 2 by ejecting them at once therefrom. The slant plate 56 has an angle of inclination by which the medals 4 accumulated thereon naturally slide down toward the game board 2 and which is specifically determined by the weight and material of the medals 4, material of the slant plate 56, and the like. Also, the slant plate 56 is adapted to be moved up till the lower end portion thereof becomes as high as the game board 2.

In the following, the process of supplementing the medals 4 will be explained with reference to FIGS. 5A and 5B.

FIG. 5A shows a state before the medals 4 are supplemented, in which the slant plate 56 is retracted to the inside of the pocket 52. Accordingly, when the medals 4 drop into the pocket 52, a predetermined amount of medals 4 are accumulated. Also, since the slant plate 56 is inclined, these medals 4 are accumulated while leaning against a side wall 57.

As shown in FIG. 5B, when the slant plate 56 is moved up by the elevator rod 54 of the elevator mechanism while the medals 4 are accumulated thereon, the elevator rod 56 stops at a point where the lower end portion of the slant plate 56 becomes as high as the game board 2, whereby the medals 4 are supplied onto the game board 2.

This medal supplement mechanism 51 is actuated when the medals 4 are detected by the jackpot detecting sections 24, and not actuated when the latter are not detected. The operational control thereof is performed similarly to that of the above-mentioned pusher 8. Specifically, as shown in FIG. 3, when the medals 4 are detected by one of the jackpot detecting sections 24, a detection signal is transmitted to the control circuit 38. Then, a control signal is transmitted from the control circuit 38 to an elevator mechanism driving section 58, whereby the elevator mechanism is driven. As a result, the medals 4 are supplemented onto the game board 2. Preferably, the control signal for driving the medal supplement mechanism 51 so as to supplement the medals 4 when the number of the medals 4 on the game board 2 decreases is transmitted later than the control signal for driving the pusher 8.

By means of the medal supplement mechanism 51, substantially the same number of medals are constantly kept on the game board 2 without decreasing in excess. Also, as the medals 4 are supplemented, new scene and development can be generated in the game, whereby the player can continuously play and further enjoy the game.

Figure 6:
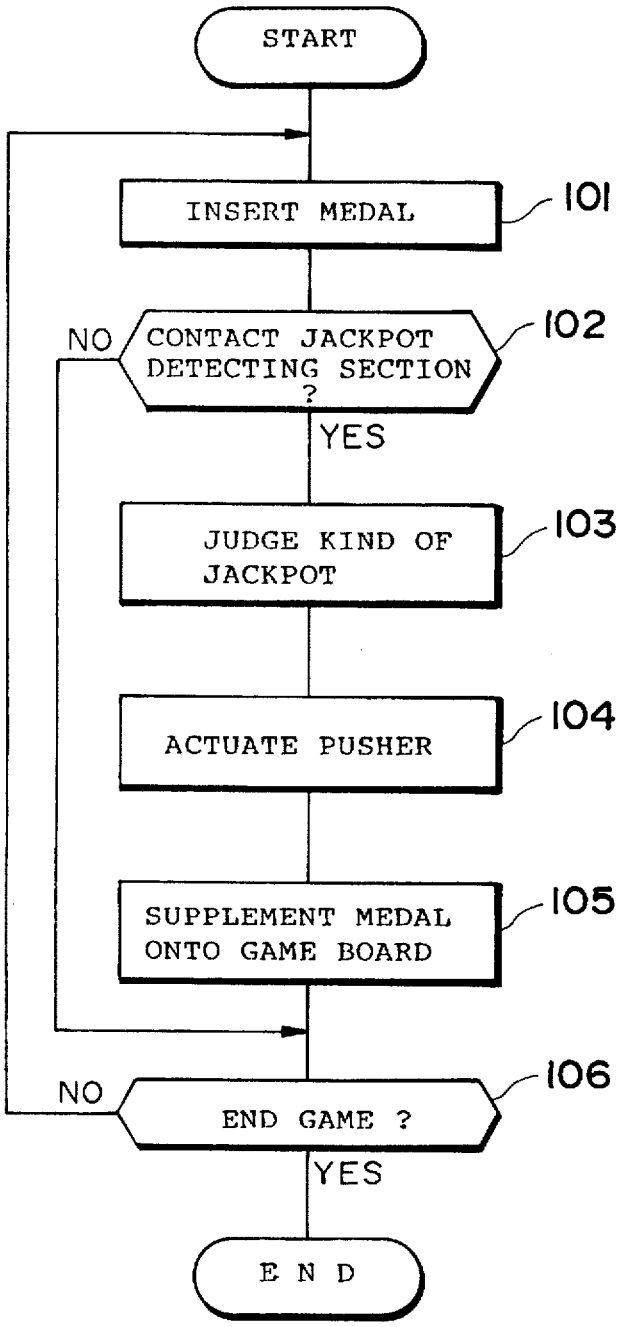
FIG. 6 is a flow chart showing a method of playing the pusher game apparatus in accordance with an embodiment of the present invention.

Based on the foregoing construction and operation, a method of playing the pusher game apparatus in accordance with the present invention will be explained with reference to the flow chart of FIG. 6.

Before starting the game, the pusher game apparatus is in a normal operation state in which the pusher 8 constantly reciprocates with its minimum stroke, i.e., stroke indicated in FIG. 4A.

When the medal 4 is inserted into the pusher game apparatus from the medal insertion slot 12 in this normal operation state (step 101), this medal 4 is guided downward by way of the zigzag guiding path 14 and the pins 18. The jackpot detecting sections 24 are disposed in the descending path of the medal 4, whereby it is judged whether or not the medal 4 is detected by the jackpot detecting sections 24. When the medal 4 is not detected by the jackpot detecting sections 24, the pusher game apparatus keeps its normal operation state, whereby the pusher 8 continues to reciprocate with the minimum stroke. By contrast, when the medal 4 is detected by one of the jackpot detecting sections 24, a detection signal is transmitted to the control circuit 38 (step 102). Based on this detection signal, the kind of jackpot detecting section 24 is judged by the control circuit 38 (step 103). According to this judgment, a control signal including information about "stroke" is transmitted from the control circuit 38 to the pusher driving section 40. Based on this control signal, the pusher 8 is moved with a stroke greater than that of its reciprocation when no medal is detected by the jackpot detecting sections 24 (step 104). Subsequently, based on the above-mentioned detection signal, a control signal is transmitted from the control circuit 38 to the elevator mechanism driving section 58, whereby the medals 4 are supplemented onto the game board 2 on the basis of this control signal (step 105). When the game is to be continued thereafter, the medal 4 is further inserted into the apparatus; otherwise the game is terminated (step 106).

Though an embodiment of the present invention is explained in the foregoing, the present invention should not be restricted thereto. For example, the above-mentioned embodiment refers to a pusher game apparatus of a type in which the medals 4 entering the chute 6 are directly dispensed to the player. Nevertheless, without being directly dispensed, the medals 4 may be accumulated as a credit, or a certain percent of the medals 4 to be dispensed to the player may be accumulated in a predetermined place (in an accumulating apparatus, for example) so as to be dispensed at once to the player with a certain timing.

In addition, the medals 4 may be dispensed as a coupon or an account.

Further, while "medal" is used as the disk in the above-mentioned embodiment, any circular object such as token or coin can be adopted similarly.

Also, in the above-mentioned embodiment, the kind of bonus is determined immediately after the medal 4 comes into contact with one of the jackpot detecting sections 24, whereby the pusher 8 is actuated. Nevertheless, a guide rail for medals which guides the medal 4 from the guiding board 16 to the proximity of the chute 6 on the game board 2 may be disposed above the game board 2. With this arrangement, the medal 4 passing through the guide rail is detected by a medal passage detector attached to the guide rail. In this case, the apparatus may be of a roulette type in which the kind of bonus is selected by means of a roulette on the basis of the detection signal of the medal passage detector, so as to actuate the pusher 8 according to thus selected bonus.

Further, though three kinds of jackpot detecting sections 24 are provided in the above-mentioned embodiment, they may be any number of kinds, and their number should not be restricted to that in the above-mentioned embodiment. For example, when only the jackpot detecting sections 24 for the big hit are provided, two kinds of strokes are sufficient therefor.

Also, while a microswitch is used as the jackpot detecting section, any other type of devices may be used as long as the medals can be detected thereby. For example, such devices as optical sensor and magnetic sensor can be used.

Further, though a linear motor is used as the pusher driving section 40, driving means of cam type and gear type can also be used as long as their strokes are variable.

Also, the medal supplement mechanism 51 should not be restricted to that of the above-mentioned embodiment. For example, a change dispenser for a vending machine, a medal dispenser for a slot machine, and the like may be used to supplement the medals 4. Such a medal supplement mechanism can determine the number of medals 4 to be supplemented in response to the kind of jackpot detecting section before supplementing the medals 4.

As explained in the foregoing, in accordance with the present invention, when the inserted medal comes into contact with the jackpot detecting section, a greater stroke is imparted to the reciprocating pusher as a bonus. As a result, a larger number of medals on the game board drop into the chute, whereby the player can acquire a greater number of medals. By chance, the pusher moves to the front end portion of the game board, whereby the player can acquire all the medals existing on the game board. Further, when the number of medals on the game board has decreased due to the bonus imparted to the player, medals are supplemented by the medal supplement mechanism. Consequently, a new game scene is presented, whereby the player can expect a new development in the game.

Thus, the present invention can provide the game with unexpectedness, giving much stronger impact on players.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No. 209785/1995 filed on Aug. 17, 1995 is hereby incorporated by reference.

What is claimed is:

1. A pusher game apparatus comprising:

a disk insertion slot into which a disk is inserted;

a guiding means for guiding downwardly the disk inserted into said disk insertion slot;

a game board disposed substantially horizontally below said guiding means so as to receive the disk dropped from said guiding means;

a discharging means disposed on at least one end side of said game board for discharging the disk out of said pusher game apparatus;

a pusher disposed slidably on said game board and movable reciprocally toward and away from the one end of said game board;

at least one jackpot detecting section for detecting the disk dropped from said guiding means;

a control means for selecting a stroke of said pusher based on a detection signal transmitted from said jackpot detecting section upon detecting the disk and for transmitting a control signal based on the thus selected stroke; and a driving means for driving said pusher capable of changing the reciprocal stroke of said pusher based on the control signal from said control means.

2. A pusher game apparatus according to claim 1, wherein said control means transmits the control signal such that the stroke of said pusher becomes greater when the disk is detected by said jackpot detecting section than when no disk is detected thereby.

3. A pusher game apparatus according to claim 1, further comprising a disk supplement mechanism for supplementing the disk onto said game board, wherein said disk supplement mechanism comprises a pocket for accumulating the disk, a slant plate which is adapted to move upward and downward within the pocket and is inclined such that a part thereof nearer to said game board is disposed lower, and an elevator mechanism for moving the slant plate upward and downward within said pocket.

4. A pusher game apparatus according to claim 3, wherein said control means actuates said disk supplement mechanism based on the detection signal from said jackpot detecting section.

5. A pusher game apparatus according to claim 3, wherein said control means actuates said disk supplement mechanism a predetermined time after the detection signal from said jackpot detecting section is received.

6. A pusher game apparatus according to claim 1, wherein the stroke of said pusher is determined beforehand according to a kind of jackpot detecting section.

* * * * *